US008388010B2

(12) United States Patent
Butts et al.

(10) Patent No.: US 8,388,010 B2
(45) Date of Patent: Mar. 5, 2013

(54) MANUAL WHEELCHAIR POWER ASSIST

(76) Inventors: Franklin Brent Butts, Salem, AL (US); John David Gowen, Tallassee, AL (US)

( * ) Notice: Subject to any disclaimer, the term of this patent is extended or adjusted under 35 U.S.C. 154(b) by 162 days.

(21) Appl. No.: 12/888,263

(22) Filed: Sep. 22, 2010

(65) Prior Publication Data

US 2011/0209931 A1 Sep. 1, 2011

Related U.S. Application Data

(60) Provisional application No. 61/308,329, filed on Feb. 26, 2010.

(51) Int. Cl.
*A61G 5/10* (2006.01)

(52) U.S. Cl. ..... 280/304.1; 280/250.1

(58) Field of Classification Search ..... 180/12, 180/11, 211, 13; 280/204, 202, 250.1, 304.1
See application file for complete search history.

(56) References Cited

U.S. PATENT DOCUMENTS 3,301,574 A * 1/1967 Good ..... 280/211
4,471,972 A * 9/1984 Young ..... 280/304.1
5,494,126 A * 2/1996 Meeker ..... 180/13
6,766,871 B2 * 7/2004 Sawyer ..... 180/13
6,896,079 B1 * 5/2005 Axelsson ..... 180/11
7,174,093 B2 * 2/2007 Kidd et al. ..... 388/811
7,216,728 B2 * 5/2007 Huang et al. ..... 180/13
7,341,121 B2 * 3/2008 Flowers et al. ..... 180/6.66
7,694,991 B2 * 4/2010 Mills et al. ..... 280/304.1
7,735,847 B2 * 6/2010 Dougherty ..... 280/304.1
2004/0000440 A1 * 1/2004 Sawyer ..... 180/13
2009/0008902 A1 * 1/2009 Kylstra et al. ..... 280/304.1
2010/0012400 A1 * 1/2010 Patmont et al. ..... 180/12
2011/0162905 A1 * 7/2011 Pearlman et al. ..... 180/447
2011/0214929 A1 * 9/2011 Filkoski et al. ..... 180/65.1

* cited by examiner

*Primary Examiner* — Tashiana Adams

(74) *Attorney, Agent, or Firm* — Gardner Groff Greenwald & Villanueva, PC

(57) ABSTRACT

A power assist apparatus for powering a manual wheelchair may include one or more wheels, one or more motors that drives the one or more wheels, a remote operable to control the one or more motors, and a connector operable to attach to the manual wheelchair. The power assist apparatus may be quickly and easily attached to, and removed from a manual wheelchair.

8 Claims, 3 Drawing Sheets

MANUAL WHEELCHAIR POWER ASSIST

RELATED APPLICATIONS

This application claims the benefit of priority to U.S. provisional patent application titled "POWER-ASSIST FOR MANUAL WHEELCHAIR USERS", application No. 61/308,329 filed Feb. 26, 2010, and incorporated herein by reference.

BACKGROUND OF THE INVENTION

The present invention generally relates to motorized devices, and more specifically relates to a device that may be attached to a manual wheelchair to assist in powering the manual wheelchair.

SUMMARY OF THE INVENTION

In one aspect of the present invention, a power assist apparatus for powering a manual wheelchair comprises one or more wheels, one or more motors that drives the one or more wheels, a remote operable to control the one or more motors, and a connector operable to attach to the manual wheelchair.

In another aspect of the present invention, a method for powering a manual wheelchair comprises attaching a power assist device to the manual wheelchair, using a remote control to control movement direction and speed of the power assist device, and driving one or more wheels on the power assist device in response to commands from the remote control.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a power assist for manual wheelchairs. A power assist device may be easily attached to a manual wheelchair so that the power assist device may pull the attached manual wheelchair. The power assist device may provide a remote, such as a joystick, that may allow the user of the wheelchair to easily control the power assist device, thereby controlling movement direction and speed of the device.

Figure 1:
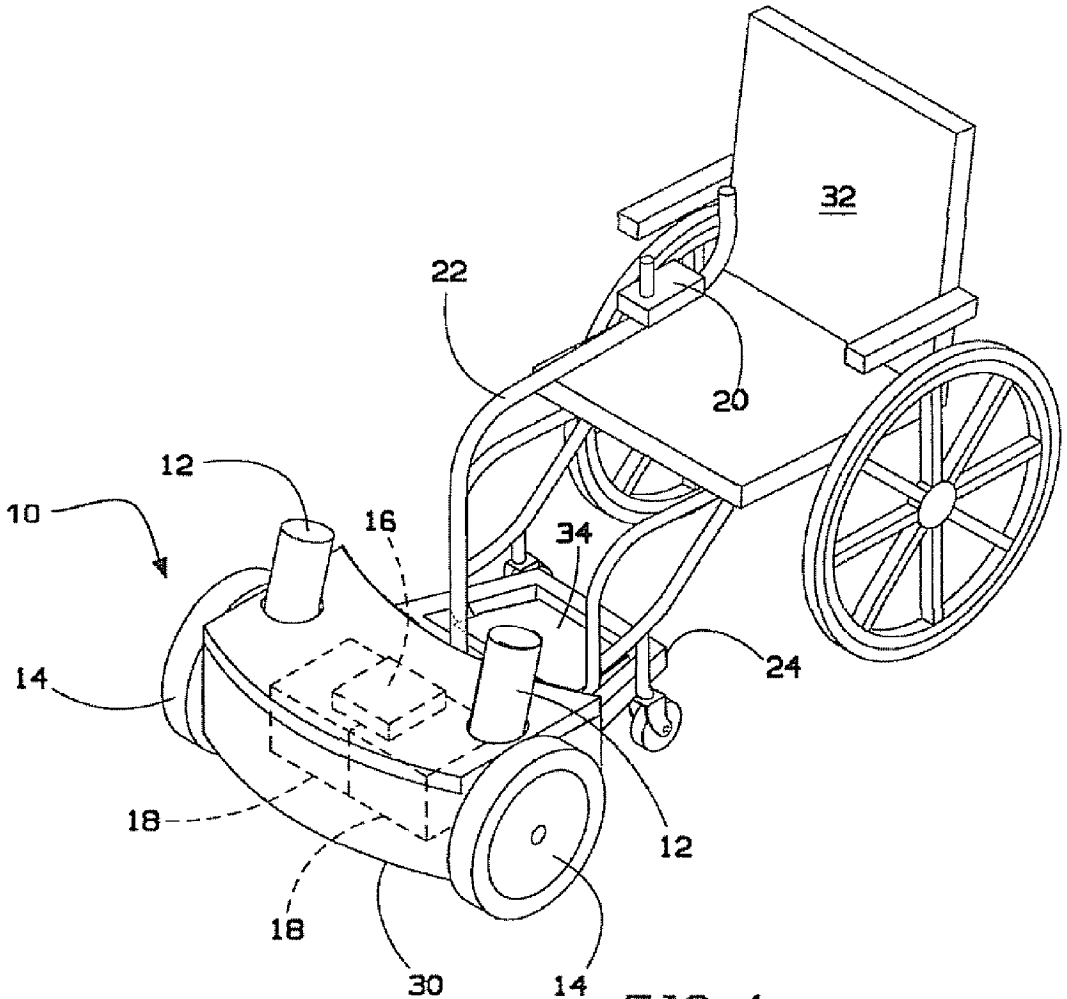
FIG. 1 shows a perspective view of a manual wheelchair power assist device in accordance with an embodiment of the present invention in use with a wheelchair.
Figure 2:
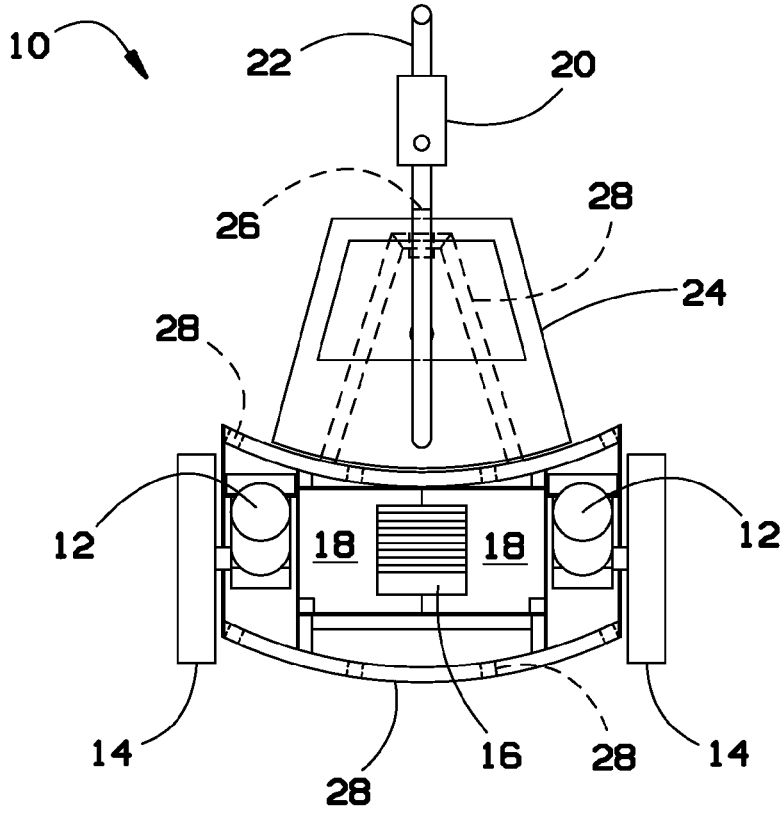
FIG. 2 shows a plan view of the manual wheelchair power assist device of FIG. 1.
Figure 3:
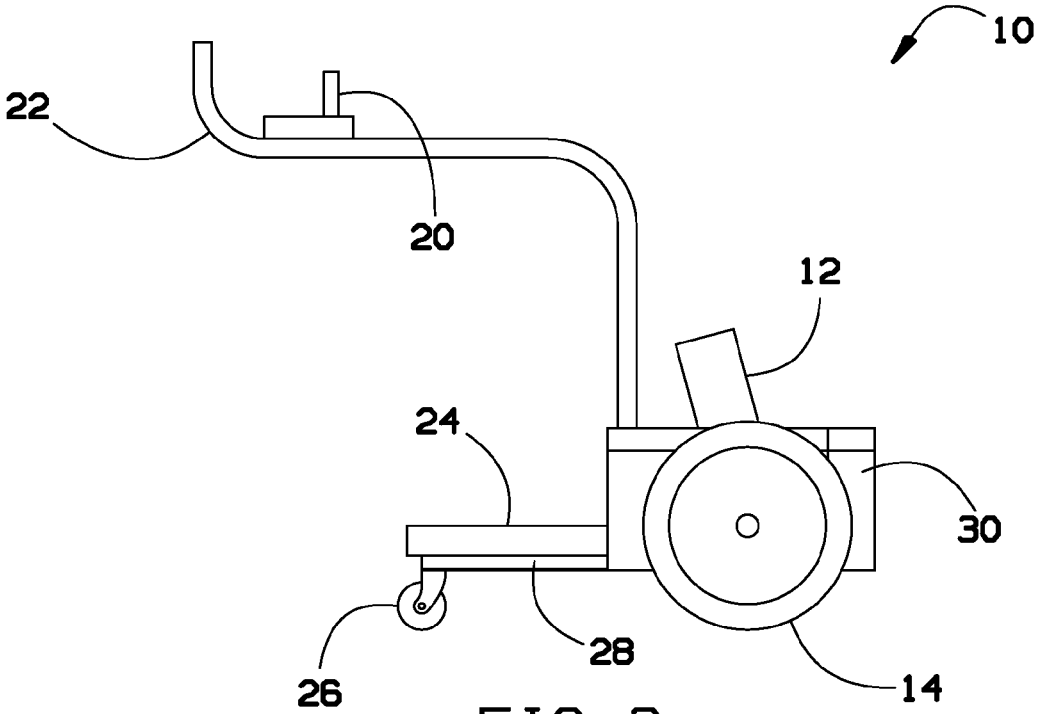
FIG. 3 shows a side elevation view of the manual wheelchair power assist device of FIG. 1.
Figure 4:
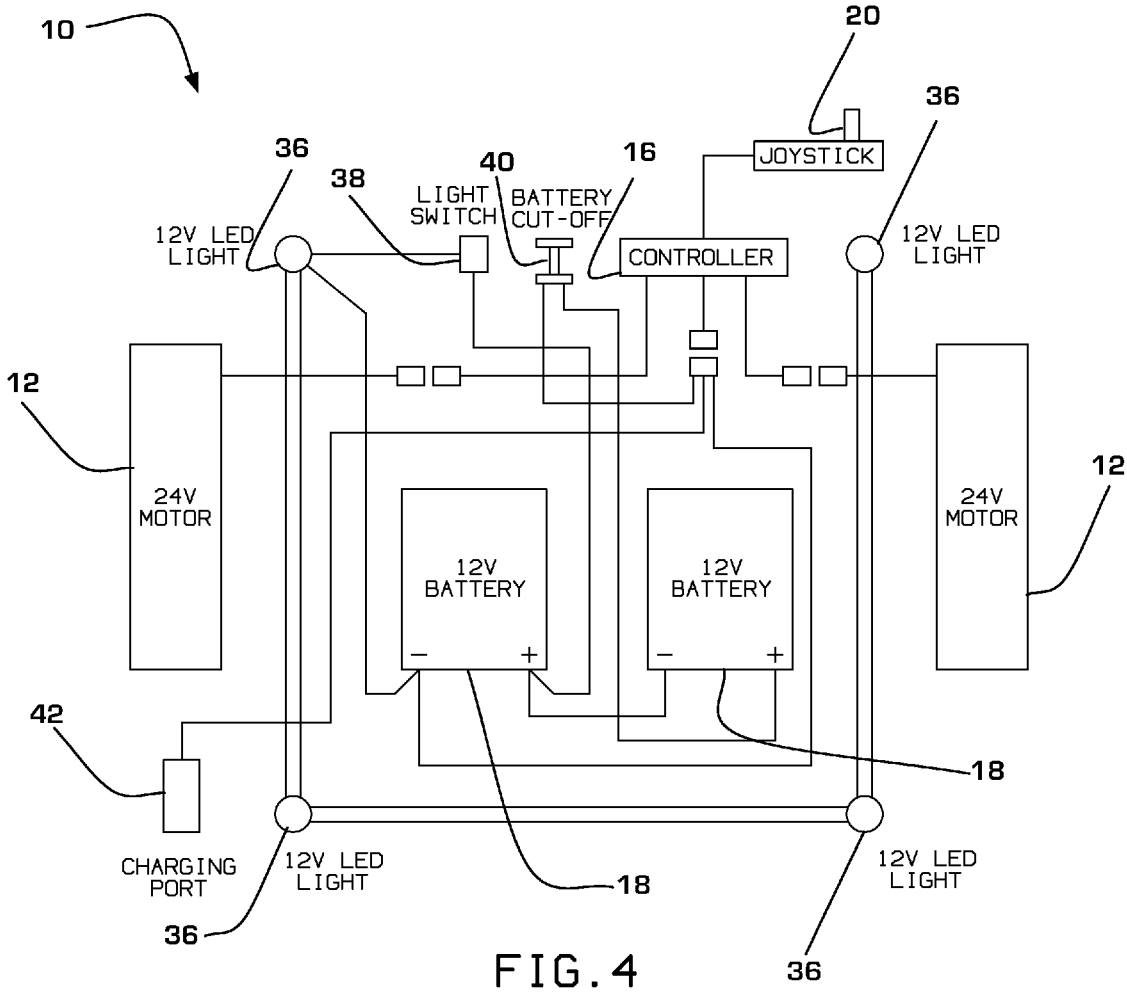
FIG. 4 shows a view of the schematics of the manual wheelchair power assist device of FIG. 1.

With reference to FIGS. 1-4, a power assist device 10 may connect to and power a manual wheelchair 32. The power assist device 10 may connect to the manual wheelchair 32 via a foot support plate holder 24 on the device 10 that may accept and connect to a manual wheelchair foot support plate 34 on the manual wheelchair 32. In one exemplary embodiment, the foot support plate holder 24 may be a plate having an indented shape that may accept the manual wheelchair foot support plate 34 into the indentation of the foot support plate holder 24. Alternatively, the foot support plate holder 24 may have one or more raised edges that may help prevent the manual wheelchair foot support plate 34 from becoming disconnected from the foot support plate holder 24 during usage of the power assist device 10.

The body power assist device 10 may be formed by a frame 28 that may be covered by a cover 30. The power assist device 10 may have a caster 26 mounted under and on the end of the frame 28 that may be used for steering the device 10 and a pair of drive wheels 14 that may be driven by a pair of drive motors 12 that may also be attached to the frame 28. The caster 26 plus the pair of drive wheels 14 may make the device in essence a three-wheel design. The caster 26 may also allow the device 10 to have nearly a zero turning radium. In alternative embodiments, the device 10 may have one or more drive wheels 12 and casters 26.

A pair of batteries 18 situated within the power assist device 10 may power the drive motors 12. In alternate embodiments, one or more batteries 18 may be used to power the drive motors 12. A control unit 16 may connect to and control the motors 12. A remote mounting bar 22 may be bolted to the wheelchair foot support table 34 and may be attached to a remote 20. The remote mounting bar 22 may be bolted to the device 10 via a swivel that may allow the remote mounting bar 22 to be rotatable side to side, up and down, and/or in and out. The remote 20 may communicate with the control unit 16 to control the drive motors 12 thereby controlling movement of the device 10. In an exemplary embodiment, the remote 20 may be a joystick, or the remote 20 may be any device suitable for use by the wheelchair user to control the movement, such as the direction and the speed, of the device 10.

In use, the user of the wheelchair 32 may cause the wheelchair 32 to tilt back and roll forward so that the wheelchair foot support plate 34 is securely inserted into the foot support plate holder 24. A pair of rods may also attach to the front of the wheelchair 32 via straps to further secure the wheelchair 32 to the device 10. The user then may swing the remote mounting bar 22 in place up and down, in and out, or side to side, and may turn on the power to the device 10 using the remote 20. The user may place one hand on the remote mounting bar 22 and use the other hand to control the remote 20.

For example, the user may move a control knob on the remote 20 to go forwards, backwards, or to make a turn. The remote 20 may cause battery power from the pair of batteries 18 to be sent to the appropriate motor or motors in the pair of drive motors 12 to drive the drive wheels 14 so that the device 10 performs as directed by the remote 20.

When the user is finished, the user may use the remote 20 to turn the device 10 off. The user may swing the remote mounting bar 22 out of the way, and then may cause the wheelchair 32 to tilt back and roll backwards to detach the device 10 from the wheelchair 32.

Additionally, lights 36, such as 12-volt LED lights, which may be controlled by a light switch 38, may be added to the front and the back of device 10 to improve the visibility of the wheelchair user at night. A battery cut-off switch 40 may be used to keep the batteries 18 from running down when the device 10 is not in use, or the battery cut-off switch 40 may be used for theft protection purposes. A charging port 42 may allow the batteries 18 to be recharged.

The frame 28 may include two 1-inch square tubing each bent into an arc about 28-inches long. Two 6-inch pieces may be welded between the two 1-inch square tubing and a 16-inch tubing may be welded to the rear of the back tubing. A ⅛-inch sheet metal may also be welded to the bottom of the frame 28.

The foot support plate holder 24 may be a pair of 16" by 12" by 1" high density polyethylene (HDPE) plates stacked on top of one another, where the top plate has an empty interior area to form a cavity that may accept and hold the manual wheelchair foot support plate 34 of the wheelchair 32. The foot support plate holder 24 may be connected to the frame 28 such as via a solid shank bolt about 2.5 inches long and ¾ inch in diameter.

The pair of drive wheels 14 may be two 3-inch by 12-inch wheels and the caster 26 may be a 3-inch wide wheel. The pair of drive motors 12 may be bolted onto motor supports on the frame 28 and may be two 24-volt motors having a 90-degree gearbox about 4-inches in diameter and 13-inches long. The batteries 18 may be placed at the bottom of the frame 28 between the pair of drive motors 12 and may be two 12-volt, —26-amp hours direct current batteries.

The remote mounting bar 22 may be a ½-inch pipe about three feet long, and may be bent in an L shape.

To make the wheelchair power assist device 10, square tubing may be bent, cut, and welded to form the frame 28. A steel plate may also be welded to the frame 28. Motor mounts for mounting the drive motors 12 may be cut and welded to the frame 28. The foot support plate holder 24 may be cut and secured to the frame 28 via a solid shank bolt. The caster 26 may be bolted to the bottom end of the frame 28. The drive motors 12 may be bolted in a near-vertical position to the motor mounts on the frame 28 and the drive wheels 14 may be connected to the drive motors 12. The batteries 18 may be installed into the frame 28 between the drive motors 12 and may be connected to the drive motors 12. The control unit 16 may be connected to the drive motors 12. The control unit 16 may also be wired to the remote 20. The remote mounting bar 22 may be cut and bent into the appropriate shape and may be mounted via a swivel to the foot support plate holder 24. The remote 20 may be attached to the remote mounting bar 22.

It should be understood, of course, that the foregoing relates to exemplary embodiments of the invention and that modifications may be made without departing from the spirit and scope of the invention as set forth in the following claims.

We claim:

1. A power assist apparatus for powering a manual wheelchair, the manual wheelchair comprising a foot support plate, the apparatus comprising:

one or more wheels;

one or more motors that drives the one or more wheels;

a remote operable to control the one or more motors; and a foot support plate holder configured to receive the foot support plate of the wheelchair, wherein a first positioning of the manual wheelchair engages the foot support plate with the foot support plate holder, and wherein a second positioning of the manual wheelchair disengages the foot support plate from the foot support plate holder.

2. The apparatus of claim 1, further comprising one or more batteries for providing power to the one or more motors.

3. The apparatus of claim 1, wherein the foot support plate holder includes a cavity that is operable to accept the foot support plate.

4. The apparatus of claim 1, wherein the remote is operable to control movement, direction and speed of the apparatus.

5. A method for powering a manual wheelchair, the manual wheelchair comprising a foot support plate, the method comprising: positioning the manual wheelchair to engage the foot support plate with a foot support plate holder of a power assist device; using a remote control to control movement, direction and speed of the power assist device; and driving one or more wheels on the power assist device in response to commands from the remote control.

6. The method of claim 5, wherein the foot support plate holder includes a cavity that accepts the foot support plate.

7. The method of claim 5, wherein the driving further comprises sending power to one or more drive motors.

8. The method of claim 5, further comprising:

positioning the manual wheelchair to disengage the foot support plate from the foot support plate holder of the power assist device.

* * * * *